US008615905B1

(12) United States Patent
Szabo et al.

(10) Patent No.: US 8,615,905 B1
(45) Date of Patent: Dec. 31, 2013

(54) MASSAGING FOOTWEAR

(76) Inventors: Edvin B. Szabo, Pompano Beach, FL (US); Sandra A. Szabo, Pompano Beach, FL (US)

( * ) Notice: Subject to any disclaimer, the term of this patent is extended or adjusted under 35 U.S.C. 154(b) by 543 days.

(21) Appl. No.: 12/883,225

(22) Filed: Sep. 16, 2010

(51) Int. Cl.
*A43B 3/12* (2006.01)
*A43B 7/00* (2006.01)

(52) U.S. Cl.
USPC ..... 36/141; 36/11.5

(58) Field of Classification Search
USPC ..... 36/11.5, 140, 141, 103, 25 R, 30 R
See application file for complete search history.

(56) References Cited

U.S. PATENT DOCUMENTS

| | | | | | |
|---|---|---|---|---|---|
| 4,109,661 | A | * | 8/1978 | Fukuoka | 36/141 |
| 4,345,387 | A | | 8/1982 | Daswick | |
| D278,571 | S | * | 4/1985 | Eber | D2/916 |
| D281,735 | S | | 12/1985 | Seltzer | |
| 4,694,831 | A | | 9/1987 | Seltzer | |
| 4,727,661 | A | * | 3/1988 | Kuhn | 36/100 |
| 4,841,647 | A | | 6/1989 | Turucz | |
| 4,852,553 | A | * | 8/1989 | Voykin | 601/28 |
| 5,322,056 | A | | 6/1994 | Menghi et al. | |
| 5,400,526 | A | * | 3/1995 | Sessa | 36/3 B |
| D373,013 | S | | 8/1996 | Rosetta | |
| 5,682,690 | A | | 11/1997 | Chang | |
| D412,390 | S | | 8/1999 | Robinson et al. | |
| 6,082,024 | A | | 7/2000 | Del Biondi | |
| 6,675,501 | B2 | * | 1/2004 | Pfander | 36/28 |
| 7,614,167 | B2 | * | 11/2009 | Klavano | 36/141 |
| 2004/0111924 | A1 | * | 6/2004 | Riccardi | 36/141 |
| 2005/0115108 | A1 | * | 6/2005 | Palchetti | 36/44 |
| 2005/0262727 | A1 | * | 12/2005 | Cheng | 36/11.5 |

* cited by examiner

*Primary Examiner* — Jila M Mohandesi
(74) *Attorney, Agent, or Firm* — Montgomery Patent & Design; Robert C. Montgomery

(57) ABSTRACT

Footwear includes an insole with integral massaging pads to aid in relaxation, relief of sore feet, and stimulation for various body parts through reflexology. A sole portion is provided with a plurality of bumps and ridges designed to impact and massage various reflex areas of the feet while walking. These bumps and ridges correspond to various areas of the foot that are linked to various points and organs in the human body such as kidneys, liver, skeletal joints, and the like. Thus, as the user walks, they experience a massaging effect resulting in increased comfort, relaxation, and overall body wellness. The beneficial features of the footwear may be incorporated various styles of footwear including sandals, shoes, boots, and the like.

9 Claims, 4 Drawing Sheets

MASSAGING FOOTWEAR

RELATED APPLICATIONS

The present invention was first described in a notarized Official Record of Invention on Jan. 23, 2009, that is on file at the offices of Montgomery Patent and Design, LLC, the entire disclosures of which are incorporated herein by reference.

FIELD OF THE INVENTION

The present invention relates generally to common footwear, and in particular, to footwear which provides integral massing and relaxation capabilities to a user during normal wear.

BACKGROUND OF THE INVENTION

Footwear are perhaps the most ubiquitous and useful articles of clothing utilized by human beings. Shoes, boots, and other similar items provide warm to lower extremities and protection from rough ground surfaces. One (1) problem commonly associated with footwear is that of discomfort to a user during extended periods of use. During any standing position or walking or running motions, the full weight of a user's body is placed upon the feet and, as a result, the user's footwear. Extended periods of standing or walking can result in great discomfort to a user's feet, knees, back, and the like. While many shoes are provided with soles to provide a function which is better than that of standing on bare ground, constant use still affects the user's well being in a negative manner.

Various attempts have been made to provide shoes with means for enhanced comfort to a user. Examples of these attempts can be seen by reference to several U.S. patents. U.S. Pat. No. 4,345,387, issued in the name of Daswick, describes a resilient inner sole for a shoe, which provides a plurality of air pockets designed to compress and absorb a portion of impact when a user's foot contacts the ground.

U.S. Pat. No. 4,694,831 issued in the name of Seltzer, describes massage footwear in which the inner sole provides upwardly projecting foot stimulating massage bumps for traction and massage purposes.

U.S. Pat. No. 5,682,690, issued in the name of Chang, describes footwear with adjustable massage units. The Chang device provides a plurality of spring-loaded massage units which provide an upward bias against a user's foot to incur a self-adjustable massaging function.

Additionally, ornamental designs for comfortable footwear exist, particularly U.S. Pat. Nos. D 281,735, D 373,013 and D 412,390. However, none of these designs are similar to the present invention.

While these devices fulfill their respective, particular objectives, each of these references suffer from one (1) or more of the aforementioned disadvantages. Many such devices do not provide support enhancing functions. Also, many such devices do not provide massaging features which offer features beyond stimulation of the bottom of a user's foot. Accordingly, there exists a need for massaging footwear without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to provide massaging footwear which enhances a user's overall wellbeing through functions of support, massaging, and reflexology. Thus, the object of the present invention is to solve the aforementioned disadvantages and provide for this need.

To achieve the above objectives, it is an object of the present invention to provide massaging footwear which aids in relaxation, relief of sore feet, and stimulation for various body parts through conventional reflexology means. The apparatus comprises a pair of footwear, each comprising an insole with a plurality of integral massaging pads.

Another object of the present invention is to impact and massage various areas of a foot during normal walking via a plurality of various-shaped pads which form bumps and ridges on the insole.

Yet still another object of the present invention is to provide conventional footwear features associated with sandals and other common types of footwear. The apparatus comprises a pair of left and right footwear with conventional features including soles and latching straps for securement to a user's foot.

Yet still another object of the present invention is to provide improved traction means on slippery surfaces via a tread surface along a bottom surface of the footwear.

Yet still another object of the present invention is to provide comfort and flexibility to a user via a laminated construction of the sole portions of the apparatus.

Yet still another object of the present invention is to provide massaging, comfort, relaxation and overall body wellness to a user during walking by providing a plurality of massaging pads which correspond in location to popular reflexology charts. The perimeter of the massaging pads comprises a plurality of heights and perimeter shapes with rounded edge portions which correspond to a particular reflexology area of the foot linked to various points and organs in the user's body.

Yet still another object of the present invention is to provide a cushioning means so as to absorb compressive forces applied during normal walking. The apparatus comprises a foam layer constructed of a supportive, dense, and flexible foam material located underneath the sole portion of the footwear.

Yet still another object of the present invention is to provide a method of utilizing the device that provides a unique means of obtaining a pair of footwear of a desired size and pad configuration, placing a corresponding left or right footwear on each of a user's feet, securing the footwear to the user's feet, and providing integral massage and reflexology functions to the user's feet during normal walking activities.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | massaging footwear |
| 20 | right shoe |
| 25 | left shoe |
| 30 | right sole |
| 35 | left sole |
| 40 | massaging pad |
| 50 | first strap |
| 55 | second strap |
| 60 | hook-and-loop-type fastener |
| 65 | tread surface |
| 70 | indicia |
| 80 | massaging layer |
| 82 | foam layer |
| 84 | tread layer |
| 86 | adhesive layer |
| 100 | fastener |
| 150 | foot |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for massaging footwear (herein described as the "apparatus") 10, which provides a pair of footwear each comprising an insole with a plurality of integral massaging pads 40 to aid in relaxation, relief of sore feet, and stimulation for various body parts through conventional reflexology means. The apparatus 10 is depicted here comprising a pair of common sandals, each providing a sole portion comprising various shaped pads 40 forming bumps and ridges designed to impact and massage various areas of a foot 150 during normal walking. These massaging pads 40 are designed to correspond thereto various areas of a foot 150 that are linked to various body points as defined by reflexology diagrams, such as those described in Pauline Wills. *The Reflexology Manual—An Easy-to-Use Illustrated Guide to the Healing Zones of the Hands and Feet*, Rochester, Vt.: Healing Arts Press, (1995). Thus, as a user walks, they experience massaging, increased comfort, relaxation, and an overall body wellness.

Figure 1:
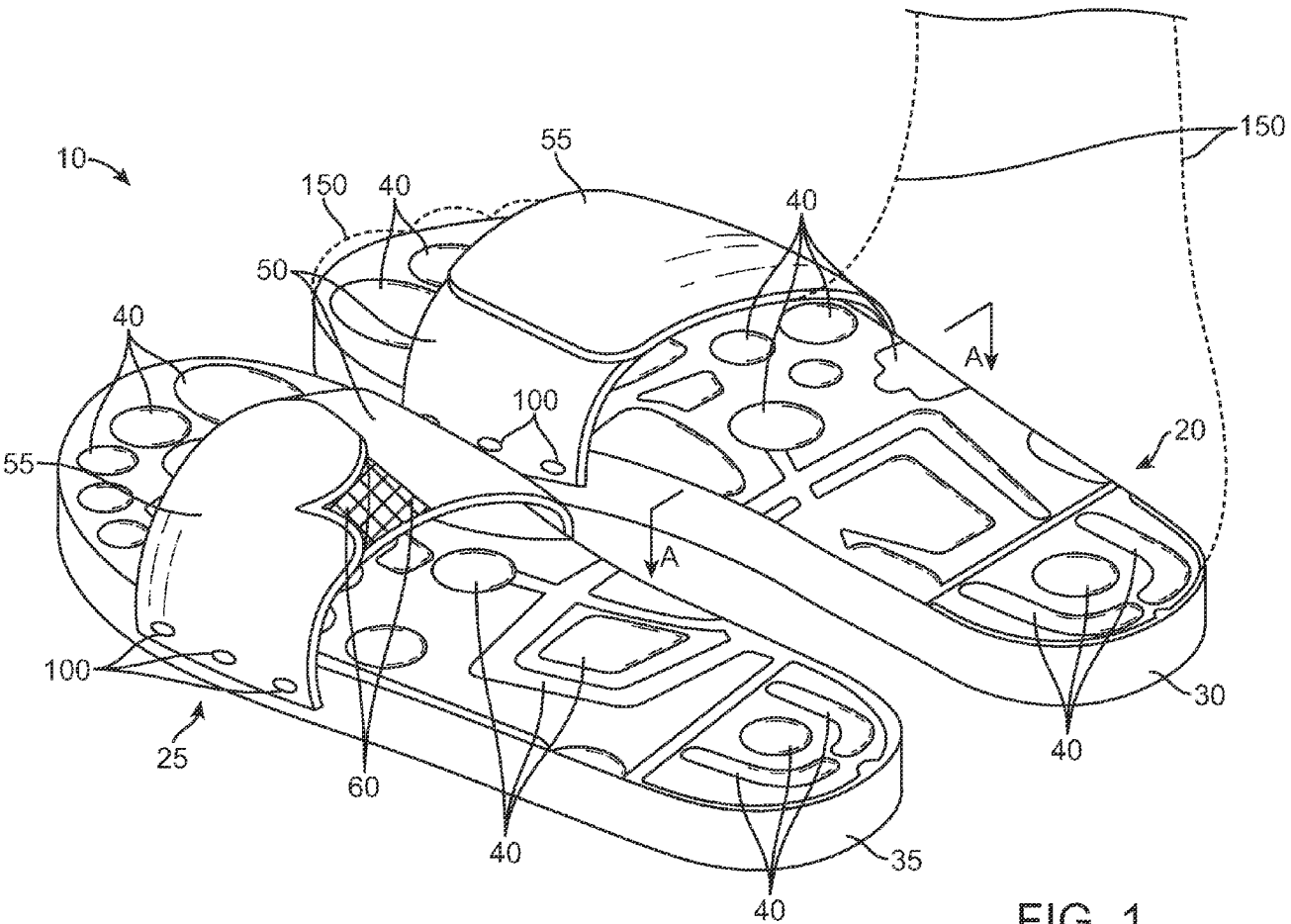
FIG. 1 is a top perspective view of a pair of massaging footwear 10, according to a preferred embodiment of the present invention; and, FIG. 2 is a bottom perspective view of the pair of massaging footwear 10, according to a preferred embodiment of the present invention.
Figure 2:
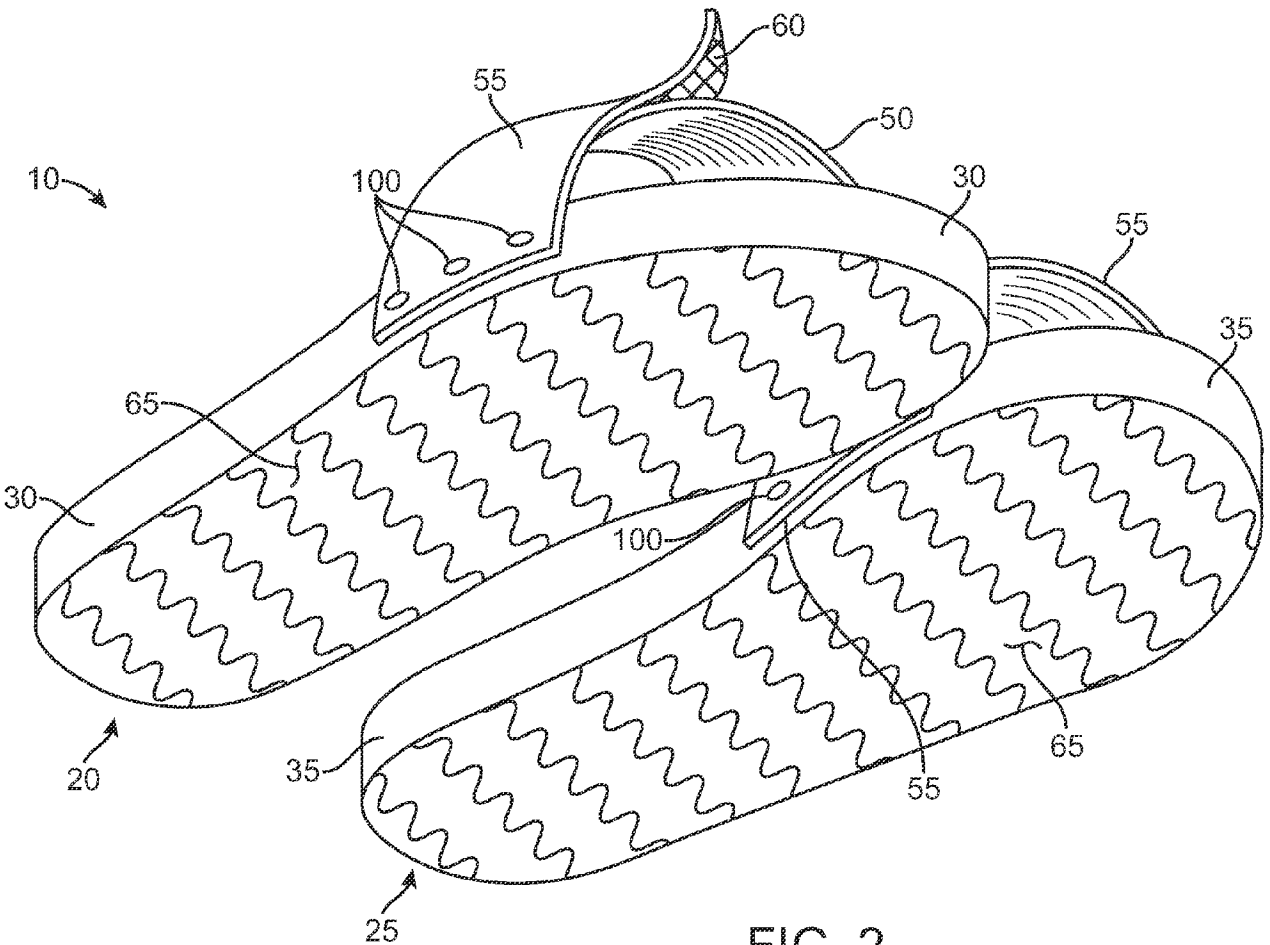

Referring now to FIGS. 1 and 2, top and bottom perspective views of the apparatus 10 according to a preferred embodiment of the present invention, are disclosed. The apparatus 10 comprises a pair of right and left footwear depicted here in a form of a common pair of sandals being a right shoe 20 and a left shoe 25 having a respective right sole 30 and a left sole 35 in a conventional manner. It is understood that the apparatus 10 is to be introduced in pairs having standard shoe sizes and widths as well as fashionable colors, patterns, and the like, in a manner similar thereto other popular footwear. Each shoe portion 20, 25 further comprises a latching strap securement further comprising first strap 50 and second strap 55 portions. Said straps 50, 55 are to be anchored along side surfaces of each sole 30, 35 using a plurality of fasteners 100 such as screws, rivets, nails, or the like. Said straps 50, 55 pass over an arch of a foot 150 and are affixed thereto each other thereat an intermediate upper position using a common hook-and-loop fastener 60 such as VELCRO®. The straps 50, 55 are envisioned being made using materials such as leather, vinyl, canvas, or the like. Although said straps 50, 55 are depicted here having a single strap affixed using a hook-and-loop fastener 60, it is understood that a person skilled in the art will appreciate that said straps 50, 55 may be provided having additional strapping members and may be affixed thereto the sole portions 30, 35 using a variety of devices and methods without deviating therefrom the concept and as such should not be interpreted as a limiting factor of the apparatus 10. The sole portions 30, 35 of the apparatus 10 further comprise a tread surface 65 along a bottom surface, thereby providing an improved traction means when applied thereto a slippery surface. Said sole portions 30, 35 further comprise a laminated construction which provides comfort and flexibility thereto a user (see FIG. 4). Although the apparatus 10 is depicted here as a pair of common sandals, it is understood that the massaging pads 40 and associated beneficial effects of the apparatus 10 may be incorporated into other styles of footwear such as, but not limited to: dress shoes, boots, athletic shoes, other sandal designs, and the like, with equal benefit to a user. Said massaging pads 40 provide a relaxing and therapeutic benefit thereto a user by utilizing established reflexology points along a bottom surface of one's foot 150 (see FIG. 3).

Figure 3:
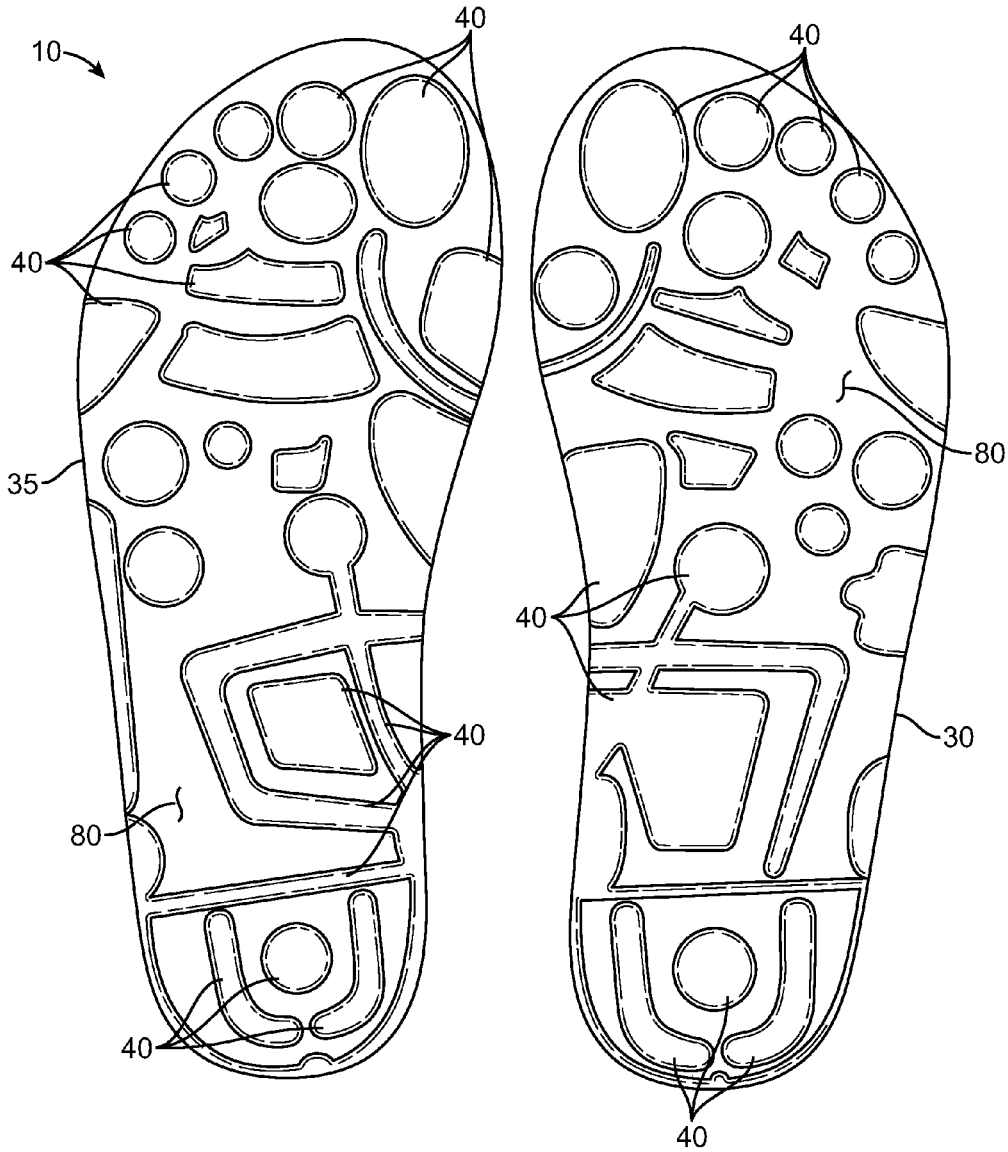
FIG. 3 is a close-up view of a massaging layer portion 80 of the pair of massaging footwear 10 depicting an arrangement of massaging pads 40, according to a preferred embodiment of the present invention; and, FIG. 4 is a section view taken along section line A-A (see FIG. 1) of an individual massaging footwear 10, according to a preferred embodiment of the present invention.

Referring now to FIG. 3, a close-up view of a massaging layer portion 80 of the apparatus 10 depicting an arrangement of massaging pads 40, according to a preferred embodiment of the present invention, is disclosed. The massaging layer 80 of each sole 30, 35 portion of the apparatus 10 comprises a plurality of differently shaped and arranged massaging pads 40. The massaging pads 40 comprise various protrusions being unique to either foot 150 and having an assortment of heights, and perimeter shapes with rounded edge portions. The perimeter of said massaging pads 40 may include such shapes as, but not limited to: dome shapes, oval shapes, rectangular shapes, and various polygons. Each massaging pad 40 corresponds thereto a particular reflexology area thereupon one's foot 150 being linked thereto various points and organs therein the body such as kidneys, liver, skeletal joints, and the like, as defined thereby conventional reflexology diagrams. Thus, as a user walks, they experience massaging, increased comfort, relaxation, and an overall body wellness. It is understood that specific positions and shapes of said massaging pads 40 may vary in relation thereto different popular reflexology charts and as such should not be interpreted as a limiting factor of the apparatus 10.

Figure 4:
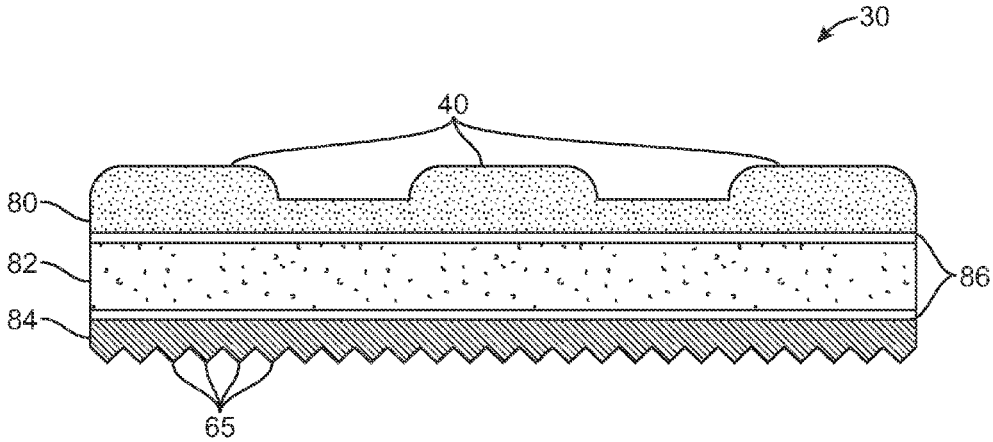

Referring now to FIG. 4, a section view taken along section line A-A (see FIG. 1) of the apparatus 10, according to a preferred embodiment of the present invention, is disclosed.

Each sole portion 30, 35 of the apparatus 10 provides a durable and comfortable laminated construction comprising a top massaging layer 80, a middle foam layer 82, and a bottom tread layer 84. It is envisioned that adjacent layers 80, 82, 84 are permanently affixed thereto each other using adhesives being commonly used in the industry. The massaging layer 80 is envisioned being approximately one-eighth (⅛) to one-quarter (¼) inch thick and made using various natural and synthetic materials such as rubber, urethane, or the like. The massaging layer 80 comprises a plurality of massaging pads 40 being integrally-molded into and protruding upwardly from a top surface, thereby providing firm support thereto one's foot 150 while also retaining a shape of each massaging pad 40 during walking. Affixed thereto said massaging layer 80 along a subjacent surface is the foam layer 82. The foam layer 82 provides a cushioning means thereto the apparatus 10 so as to absorb compressive forces applied thereto by a user during normal walking. The foam layer 82 is envisioned to be approximately one-half (½) to one (1) inch thick and made using a supportive, dense, and flexible foam material such as urethane or equivalent compound. Affixed thereto said foam layer 82 along a subjacent surface thereof is the tread layer 84 which provides a durable gripping means along a bottom surface. The tread layer 84 provides a textured tread surface 65 comprising various protruding edges in a similar fashion as a vehicle tire surface, thereby maintaining sufficient surface tension to avoid slipping when walking on a slippery surface. The tread surface 84 is envisioned to be approximately one-eighth (⅛) to one-quarter (¼) inch thick and made using medium-hard, or reinforced laminated rubber compounds.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be utilized as indicated in FIGS. 1 and 2.

The method of installing and utilizing the apparatus 10 may be achieved by performing the following steps: placing one (1) foot 150, then the other foot 150 respectively into right 20 and left 25 shoe portions in a normal manner; wrapping the pairs of first 50 and second 55 straps over and around an arch portion of one's foot 150; pulling said straps 50, 55 inwardly until snug around each foot 150; attaching the straps 50, 55 using the hook-and-loop fasteners 60; allowing the massaging pads 40 to massage corresponding reflex areas of one's foot 150 based upon established reflexology charts; and, benefiting from increased relaxation, relief of sore feet, and stimulation of various body parts, during a normal walking activity using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A massaging footwear for aiding relaxation, relieving sore feet and stimulating the body, said massaging footwear comprising: right and left footwear, each of said right and left footwear comprising a sole including:

a laminated construction having a plurality of layers;

a tread surface located along a bottom surface of said laminated construction for providing traction on a slippery surface;

first and second latching strap portions attached to said sole for securing a user foot on said sole; and, a plurality of fasteners anchoring said latching strap portions to said sole;

wherein said layers comprise:

a top massaging layer;

a middle foam layer affixed to a subjacent surface of said massaging layer;

a first adhesive layer directly intercalated between said top massaging layer and said middle foam layer;

a bottom tread layer affixed to a subjacent surface of said middle foam layer; and a second adhesive layer directly intercalated between said middle foam layer and said bottom tread layer;

wherein said top massaging layer comprises a plurality of massaging pads integral with a top surface of said top massaging layer and upwardly protruding from said top surface of said top massaging layer, wherein each of said massaging pads have a unique height and shape with rounded edge portions adapted to be correspondingly positioned to a particular reflexology area linked to various points and organs of a user body;

wherein said top massaging layer is permanently affixed to said middle foam layer;

wherein said middle foam layer is permanently affixed to said bottom tread layer;

wherein said middle foam layer has planar top and bottom surfaces;

wherein said bottom tread layer has a planar top surface; and, wherein said top massaging layer has a planar bottom surface.

2. The massaging footwear of claim 1, wherein said first and second latching strap portions are affixed to each other at an intermediate upper position around an arch of the user foot.

3. The massaging footwear of claim 1, wherein said middle foam layer absorbs compressive forces applied by a user during walking and thereby cushions the user foot;

wherein said bottom tread layer is adapted to grip a walking surface.

4. The massaging footwear of claim 1, wherein said top massaging layer retains said unique height and shape associated with each of said massaging pads during walking.

5. A massaging footwear for aiding relaxation, relieving sore feet and stimulating the body, said massaging footwear comprising: right and left footwear, each of said right and left footwear comprising a sole including:

a laminated construction having a plurality of layers;

a tread surface located along a bottom surface of said laminated construction for providing traction on a slippery surface;

first and second latching strap portions attached to said sole for securing a user foot on said sole; and, a plurality of fasteners anchoring said latching strap portions to side surfaces of said sole;

wherein said layers comprise:

a top massaging layer;

a middle foam layer affixed to a subjacent surface of said massaging layer;

a first adhesive layer directly intercalated between said top massaging layer and said middle foam layer;

a bottom tread layer affixed to a subjacent surface of said middle foam layer; and, a second adhesive layer directly intercalated between said middle foam layer and said bottom tread layer;

wherein said top massaging layer comprises a plurality of massaging pads integral with a top surface of said top massaging layer and upwardly protruding from said top surface of said top massaging layer, wherein each of said massaging pads have a unique height and shape with rounded edge portions adapted to be correspondingly positioned to a particular reflexology area linked to various points and organs of a user body;

wherein said top massaging layer is permanently affixed to said middle foam layer;

wherein said middle foam layer is permanently affixed to said bottom tread layer;

wherein said middle foam layer has planar top and bottom surfaces;

wherein said bottom tread layer has a planar top surface; and, wherein said top massaging layer has a planar bottom surface.

6. The massaging footwear of claim 5, wherein said first and second latching strap portions are affixed to each other at an intermediate upper position around an arch of the user foot.

7. The massaging footwear of claim 5, wherein said middle foam layer absorbs compressive forces applied by a user during walking and thereby cushions the user foot;

wherein said bottom tread layer is adapted to grip a walking surface.

8. The massaging footwear of claim 5, wherein said top massaging layer retains said unique height and shape associated with each of said massaging pads during walking.

9. A method of utilizing a massaging footwear for aiding relaxation, relieving sore feet and stimulating the body, said method comprising the steps of:

providing right and left footwear by performing the following sub-steps for each of said right and left footwear:

providing a laminated construction having a plurality of layers:

a top massaging layer having a planar bottom surface and further comprising a plurality of massaging pads integral with and upwardly protruding from a top surface thereof, wherein each of said massaging pads have a unique height and shape with rounded edge portions adapted to be correspondingly positioned to a particular reflexology area linked to various points and organs of a user body;

a middle foam layer permanently affixed to a subjacent surface of said massaging layer, further having planar top and bottom surfaces;

a first adhesive layer directly intercalated between said top massaging layer and said middle foam layer;

a bottom tread layer permanently affixed to a subjacent surface of said middle foam layer, further having a planar top surface; and, a second adhesive layer directly intercalated between said middle foam layer and said bottom tread layer;

providing traction on a slippery surface by providing and locating a tread surface along a bottom surface of said laminated construction;

securing a user foot on said sole by providing and attaching first and second latching strap portions to said sole; providing a plurality of fasteners; and, anchoring said latching strap portions to side surfaces of said sole via said fasteners.

* * * * *